US007128934B1

(12) United States Patent
Ohta et al.

(10) Patent No.: US 7,128,934 B1
(45) Date of Patent: Oct. 31, 2006

(54) DRINK-EXTRACTING BAG EQUIPPED WITH HOLDING ELEMENT

(75) Inventors: Keiji Ohta, Yokohama (JP); Kaichi Suzuki, Kyoto (JP)

(73) Assignees: Key Coffee, Inc. (JP); Yamanaka Sangyo Kabushiki Kaisha (JP)

( * ) Notice: Subject to any disclaimer, the term of this patent is extended or adjusted under 35 U.S.C. 154(b) by 0 days.

(21) Appl. No.: 09/171,497

(22) PCT Filed: Feb. 20, 1998

(86) PCT No.: PCT/JP98/00703

§ 371 (c)(1),
(2), (4) Date: Mar. 5, 1999

(87) PCT Pub. No.: WO98/36991

PCT Pub. Date: Aug. 27, 1998

(30) Foreign Application Priority Data

Feb. 21, 1997 (JP) ..... 9-037485
Aug. 29, 1997 (JP) ..... 9-234889

(51) Int. Cl.
*A47J 31/10* (2006.01)
*B65D 33/14* (2006.01)

(52) U.S. Cl. ..... 426/82; 426/77; 426/112; 426/433; 426/435; 99/306; 99/322

(58) Field of Classification Search ..... 426/77, 426/82, 112, 115, 433, 435; 99/306, 322
See application file for complete search history.

(56) References Cited

U.S. PATENT DOCUMENTS 3,344,734 A * 10/1967 Aguirre-Batres et al. ..... 426/77
3,556,392 A * 1/1971 Robin ..... 426/83
3,615,708 A * 10/1971 Abile-Gal ..... 426/77
3,695,167 A * 10/1972 Schmidt et al. ..... 426/77
4,391,366 A * 7/1983 Hirata ..... 426/115
4,519,911 A * 5/1985 Shimizu ..... 426/82
4,584,101 A * 4/1986 Kataoka ..... 426/82
4,715,271 A * 12/1987 Kitagawa ..... 426/82
4,863,601 A * 9/1989 Wittekind et al. ..... 426/82
5,059,325 A * 10/1991 Iida ..... 426/82
5,132,124 A * 7/1992 Tamaki et al. ..... 426/77
5,605,710 A * 2/1997 Pridonoff et al. ..... 426/77

FOREIGN PATENT DOCUMENTS

| | | | | |
|---|---|---|---|---|
| DE | 2235214 | * | 1/1974 | 426/77 |
| DE | 3638990 | * | 5/1988 | 426/77 |
| EP | 54099 | * | 5/1993 | 426/77 |
| JP | 57-11763 | * | 6/1955 | 425/77 |
| JP | 50-39822 | * | 11/1975 | 426/77 |
| JP | 60-57556 | * | 4/1985 | 426/82 |
| JP | 63-95528 | * | 6/1988 | 426/433 |
| JP | 4-158820 | | 10/1990 | |
| JP | 4-84914 | | 3/1992 | |
| JP | 6-115561 | * | 4/1994 | 426/77 |
| JP | 9-131263 | | 5/1997 | |
| WO | WO94/05549 | * | 3/1994 | 426/82 |

* cited by examiner

*Primary Examiner*—Steven Weinstein
(74) *Attorney, Agent, or Firm*—Anderson Kill & Olick, PC

(57) ABSTRACT

A support-equipped extracting bag for a drink, for example coffee, comprises an extracting bag member 2 containing therein a drink material to be extracted and having a front face section 2*a* and back face section 2*b* each comprising a filtering sheet; and a support member 3 attached to the bag member and covering an upper half portion of the bag member, to hygienically keep a top end of the bag member to be opened during storage and to enable the bag member to be stably and safely held in a cup, wherein the upper middle portion of the support member and the upper portion of the bag member can be opened by removing the upper middle portion of the support member and the upper portion of the bag member along cut lines 8 and 9 or vacant area 10 or 11 and a row of perforations 13 formed through the support and bag members, and by bending the right and left side upper portions of the support member inward along folds or dotted cuts 14 and 15 formed in the right and left side upper portions of the support member.

12 Claims, 9 Drawing Sheets

DRINK-EXTRACTING BAG EQUIPPED WITH HOLDING ELEMENT

TECHNICAL FIELD

The present invention relates to a drink-extracting bag equipped with a support for holding it on a cup. More particularly, the present invention relates to a drink-extracting bag which can be stored while keeping the bag in a hygienically sealed condition and can be subjected to extracting procedures in which the extracting bag member is placed stably and safely on a cup through a support member, and then the drink material is hygienically extracted in a drip-extracting manner, and then in an immersion extracting manner.

TECHNICAL BACKGROUND

Currently, in extraction of a drink, for example coffee, by a drip extracting system, employment of a disposable extraction bag comprising an extracting bag member and a support member for the bag member is common.

For example, Japanese Examined Utility Model Publication No. 5-13,324 discloses a filtering device comprising paper strip pieces folded into two plies, a filtering bag inserted between the folded paper strip plies, and a push-opening section formed in a middle portion of the fold of the folded paper strips by cutting the fold middle portion so as to enable the push-opening section to be pushed inward. In this filtering device, when the push-opening section is pushed inward, the folded paper strip plies and the filtering bag inserted between the folded paper strip plies can be opened.

Also, Japanese Examined Utility Model Publication No. 60-7622 discloses a coffer-filtering device in which an extraction bag is attached to a rectangular thick paper piece having a hole formed in the center portion thereof, and holding hooks for holding the bag on an upper edge of a cup are formed, in right and left side portions of the rectangular thick paper piece, by cutting. When the rectangular thick paper piece is bent, the holding hooks can catch the upper edge of the cup.

Further, Japanese Examined Utility Model Publication No. 57-10,270 discloses a coffer-filtering device in which a filtering bag is attached to the inside face of a frame member capable of being formed into a rectangular hollow pillar, and the rectangular hollow pillar can be placed on a cup so as to locate the filtering bag in the cup.

The above-mentioned conventional extracting bags with supports are disadvantageous in that when the bag is opened, the fingers of the user touch the bag; the opened support and bag are difficult to keep at a desired opened condition constantly, and the support placed on the cup is instable.

SUMMARY OF THE INVENTION

An object of the present invention is to provide a drink-extracting bag equipped with a support for holding it on a cup, which is capable of keeping a top portion of a bag member to be opened, before using, in a hygienic condition and of holding the bag member, when used, in a cup, through a support member, while keeping the bag member in stable and safe conditions.

Another object of the present invention is to provide a drink-extracting bag equipped with a support for holding it on a cup, which enables a drink material contained in a bag member to be hygienically and safely extracted in a successive drip and immersion extraction manner.

The above-mentioned objects can be attained by the drink-extracting bag equipped with a support for holding the bag on a cup, of the present invention, which comprises:

a closed support member 3 attached to the bag member, wherein;

(1) said closed support member has a front face section 4 and a back face section 4*a*, each face section having a right and left side edge, a common top edge and a lower end which sections join each other through the common top edge forming a ridgeline 5, and said sections are connected to each other at the right and left side edges 6 and 7 of each face section, said support member being wider than the closed bag member and sufficiently wide to be positioned onto the rim of said cup when said support member is in an open position;

(2) an upper half portion of the extracting bag member being completely covered by the front and back face sections of the support member such that the top edge of the bag does not extend above the top edge of the support member and a lower half portion of the extracting bag member extends downward below the lower ends 18*a* of the front and back face sections of the support member;

(3) a pair of cut lines 8 and 9 or vacant areas 10 or 11 formed in an upper portion of each of the front and back face sections of the support member, each cut line or vacant area extending from the ridgeline at a point spaced from said right and left side edges of said support member, respectively, downwardly toward the inside of the support member and located outside of the right and left side edges of the bag member;

(4) the inner surfaces of the front and back face sections of the support members are respectively adhered to the corresponding upper portions of outer surfaces of the front and back face sections of the bag member in adhesion regions 12 located below and close to a pair of straight lines 8*a*–9*a* drawn between lowermost ends 8*a* and 9*a* of the pair of cut lines or vacant areas of the front and back face sections of the support member;

(5) a row of perforations 13 for cutting or tearing are formed through an upper middle portion of the front and back face sections of the support member and through the top portion of the front and back face sections of the bag member, along the straight line 8*a*–9*a;*

(6) at least one pair of folds or dotted cuts 14 and 15 are formed in the right and left side upper portions of each of the front and back face sections of the support member between said side edges of said face sections and said cut lines or vacant areas of said face sections, to enable the right and left side upper portions of said face sections to be bent inward along the folds or dotted cuts; and (7) the support member and the top portion of the bag member can be opened by removing the upper middle portion of the support member and the top portion of the bag member along the cut lines or vacant areas and the row of perforations, and by bending the right and left side upper portions of the support member inward.

In the support-equipped extracting bag of the present invention, the bag member preferably has a lower portion thereof extending downward over lower ends 18*a* of the front and back face sections of the support member 3.

In the support-equipped extracting bag of the present invention, a pair of lower end projections 16 and 17 may extend downward from lower ends 18*a* of the right and left side edges of the front and back face sections of the support member through which side edges and the front and back face sections of the support member are connected to each other.

In the support-equipped extracting bag of the present invention, a pair of middle aprons 18 preferably extend downward from middle portions of the lower ends 18*a* of the front and back face sections of the support member.

In the support-equipped extracting bag of the present invention, right and left side portions 20 of each of the middle aprons 18 of the front and back face sections of the support member may be in a zigzag form.

In the support-equipped extracting bag of the present invention, two pairs of transverse arms 22 and 23 may extend from the lower end projections 16 and 17 of the support member toward a center of the lower end of the support member.

In the support-equipped extracting bag of the present invention, the bag member has a pair of right and left side face sections 33 and 34 formed between the front and back face sections, the lower ends of the front back and side face sections are connected altogether to form a straight line-formed bottom 35, and each of the right and left side face portions 33 and 34 being folded inward to form a gusset.

The method of the present invention for extracting a drink by employing the drink-extracting bag equipped with a support for holding it on a cup, as mentioned above, comprises:

removing the upper middle portion of the support member and the top portion of the bag member, along the row of perforations formed in the support member and the bag member;

bending the right and left side upper portions of the support member inward, to open the upper middle portion of the support member and the top portion of the bag member;

placing the opened support-equipped extracting bag on a cup in such a manner that the lower end of the support member comes into contact with an upper edge of the cup and the bag member is positioned in the cup;

pouring hot water into the bag member through the opened top end thereof to apply a drip extraction to the drink material in the bag member to allow the extracted drink to fall into the cup through the bag member and to be collected in the cup, and then to allow the residual drink material in the bag member to be immerse extracted by the collected drink in the cup.

BEST MODE OF CARRYING OUT THE INVENTION

In the present invention, the drink materials to be contained in the extracting bag equipped with a support for holding it in a cup are not limited to specific types of materials. Usually, the drink materials include coffee, black tea, cocoa, oolong tea, green tea, barley water and seaweed drink. Among them, coffee is preferably used for the present invention.

The constitution of an embodiment of the drink extracting bag equipped with a support for holding it in a cup, of the present invention will be illustrated below, with referring to FIG. 1.

Figure 1:
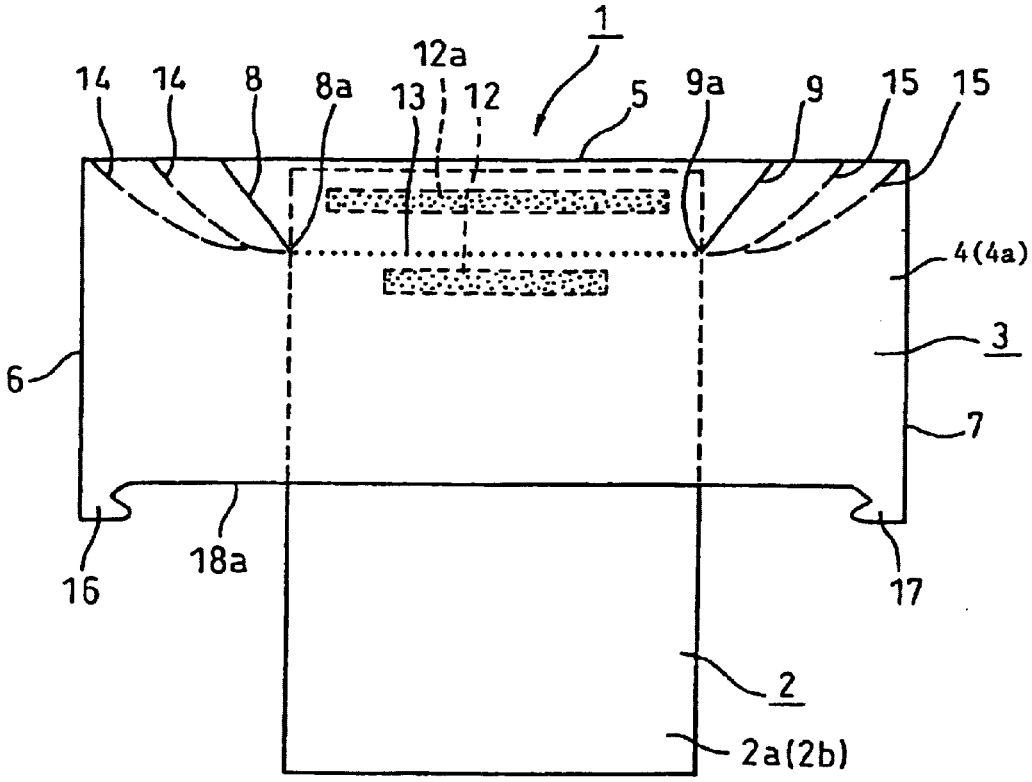
FIG. 1 shows an explanatory front view of an embodiment of the drink-extracting bag equipped with a support, of the present invention.

FIG. 1 shows a front view of an embodiment of the drink-extracting bag of the present invention.

In FIG. 1, a support-equipped extracting bag 1 has an extracting bag member 2 made from a filtering sheet and containing and sealing therein a material from which a drink is extracted, and a support member 3 attached to the bag member 2 and covering therewith the upper half portion of the bag member 2.

In FIG. 1, the extracting bag member 2 is formed from a filtering sheet and has a front face section 2*a* and back face section 2*b* facing each other. Also, in the bag member 2, the right and left side edges and bottom thereof are joined to each other or sealed by adhesion, and the top thereof is sealed by adhesion after a drink material is placed in the bag member. A lower half portion of the extraction bag member 2 extends downward over a lower end 18*a* of the support member 3, and thus when the extracting bag is subjected to an extracting procedure, first, a drip extraction is applied to the drink material contained in the bag member 2, and then the residual drink material in the bag member 2 is immerse-extracted by the resultant extract liquid. The extracting bag member 2 may have side face sections by which gussets of the bag member are formed.

In FIG. 1, a support member 3 has a front face section 4 and a back face section 4*a* facing each other. The front and back face sections 4 and 4*a* continue to each other at a top thereof to form a ridgeline 5. Also, the front and back face sections 4 and 4*a* are connected to each other at both the right and left side edges 6 and 7 to form a bag opening downward.

On the inside of middle portions of the front and back face sections 4 and 4*a* of the support member 3, an upper half portion of the extract bag member 2 is located and interposed between the middle portions. Also, in the upper portions of the front and back face sections 4 and 4*a* of the support member, a pair of cutting lines 8 and 9 are formed from the ridgeline 5 inward, on the outside of both the right and left side edges of the extracting bag member 2. In the embodiment shown in FIG. 1, the pair of cut lines 8 and 9 are inclined inwardly from the outside of the location of the extracting bag member 2.

In the extracting bag 1 in FIG. 1, a pair of adhesion regions 12 are provided on the front and back face sections 4 and 4*a* of the support member 3 and below and close to a pair of straight lines 8*a*–8*b* drawn between lower ends 8*a* and 9*a* of the pair of cut lines 8 and 9, and in the adhesion regions 12, the inner surfaces of the front and back face sections of the support member 3 are adhered to the corresponding outer surfaces of the front and back face sections 2*a* and 2*b* of the extracting bag member 2.

Also, a row of perforations 13 formed through the front and back face sections of the support member 3 and the front and back face sections 2*a* and 2*b* of the extracting bag member 2 located between the front and back face sections of the support member, are formed along the above-mentioned straight lines 8*a*–8*b*. Further, since the cut lines 8 and 9 are formed in the upper portions of the front and back face sections 4 and 4*a* of the support member 3 and outside of the right and left side edges of the extracting bag member 2, and connected to the row of the perforations 13, when the upper portions of the support member 3 and the extracting bag member 2 are torn and removed along the row of the perforations 13, a vacant space is formed in the upper middle portion of the support member 3 and simultaneously a top portion of the extracting bag member 2 is removed. Thus the extracting bag member 2 becomes openable at the top end thereof.

In the embodiment as shown in FIG. 1, at least one pair of folds or dotted cut lines 14 and 15 are formed in the right and left side portions of the support member 3 so as to enable the right and left side portions to be pushed and bent inward.

Figure 2A:
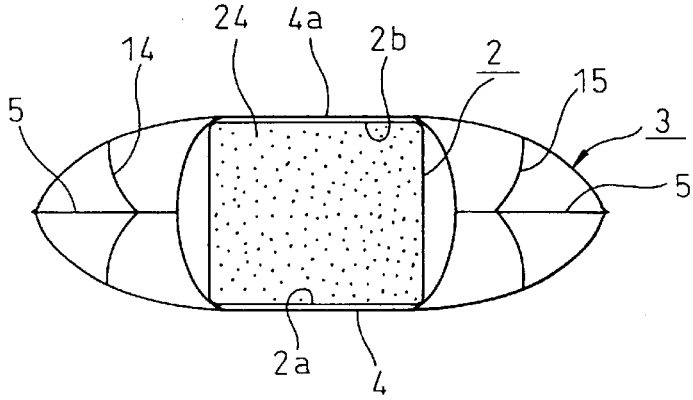
FIG. 2A shows an explanatory plane view of the support-equipped extracting bag shown in FIG. 1, when the bag is opened.
Figure 2B:
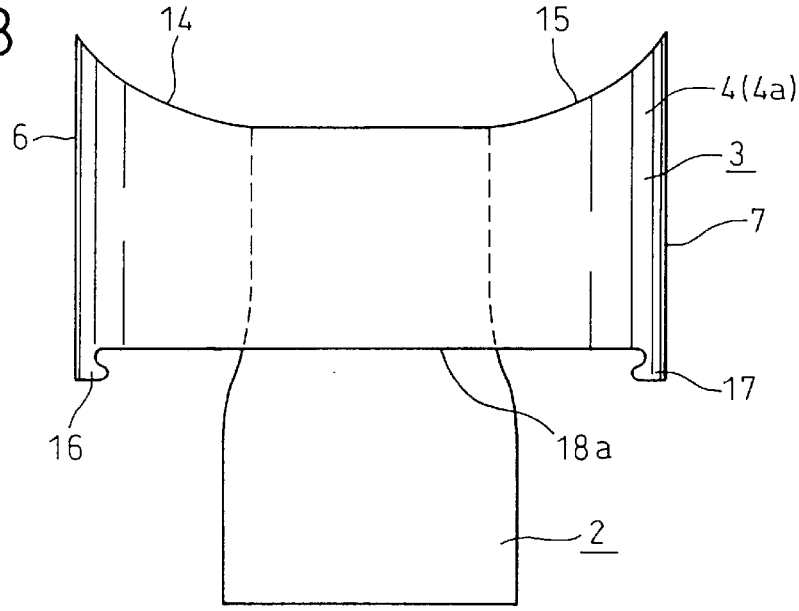
FIG. 2B shows an explanatory front view of the opened, support-equipped extracting bag shown in FIG. 2A.

In the extracting bag equipped with the support and having the above-mentioned constitution, when the upper middle portion of the support member 3 and the top portion of the extracting bag member 2 are torn off along the row of the perforations 13, and then the right and left side upper portions of the support member 3 are bent inward along the fold or dotted cut lines 14 and 15, the front and back face sections 4 and 4*a* of the support member 3 are opened in the form of a substantial ellipse, around axes consisting of the right and left side edges through which the front and back face sections 4 and 4*a* are connected to each other as shown in FIGS. 2A and 2E;. Also, the top portions of the front and back face sections 2*a* and 2*b* of the extracting bag member 2, which face sections 2*a* and 2*b* are adhered to the front and back face sections 4 and 4*a* of the support member 3 through the adhesion regions 12, are opened.

Where the support-provided extracting bag of the present invention, opened as mentioned above, is placed on a container such as cup in such a manner that the bottom of the opened support member comes into contact to the upper edge of the cup, a lower portion of the extracting bag member is located in the form of a suspension in the container (cup). Since the top end of the extracting bag member is open, a drink can be safely extracted from the drink material 24 contained in the extracting bag member by pouring an extracting medium such as hot water into the extracting bag member through the top opening thereof.

When the tearing procedure and opening procedure are carried out by hand fingers of the operator, the fingers are brought into contact with only the support member 3 but not with the extracting bag member 2. Therefore, in the tearing and opening procedures, the open end portion of the extracting bag member 2 is not polluted by the fingers, and the preparation procedures for the extracting procedures can be very hygienically carried out.

Also, the outer upper portions of the front and back face sections of the extracting bag member are preferably adhered to the inner upper portions of the front and back face sections of the support member through adhesion regions 12*a* as shown in FIG. 1. In this case, in the tearing-off procedure, no slippage occurs between the upper portions of the support member and the upper portions of the extracting bag member, and thus all the upper portions can be easily and surely teared and removed.

In the support-equipped extracting bag of the present invention, to stably and safely hold the support member on the cup, a pair of lower end projections 16 and 17 are preferably extended from the lower ends of the right and left edges of the front and back face sections 4 and 4*a* of the support member 3, at which edge portions the front and back face sections 4 and 4*a* are connected to each other, as shown in FIG. 1. When the lower end projections 16 and 17 are provided, the lower ends 18*a* of the front and back face sections 4 and 4*a* of the support member 3 are formed in an upwardly cut-out form. Therefore, when the support member is placed on a cup, the top edges of the cup are interposed between the lower end projections 16 and 17, and thus even when the support moves right or left side, the support member does not run outside of the top edge of the cup and thus an accident in the extracting procedure can be prevented.

Figure 3:
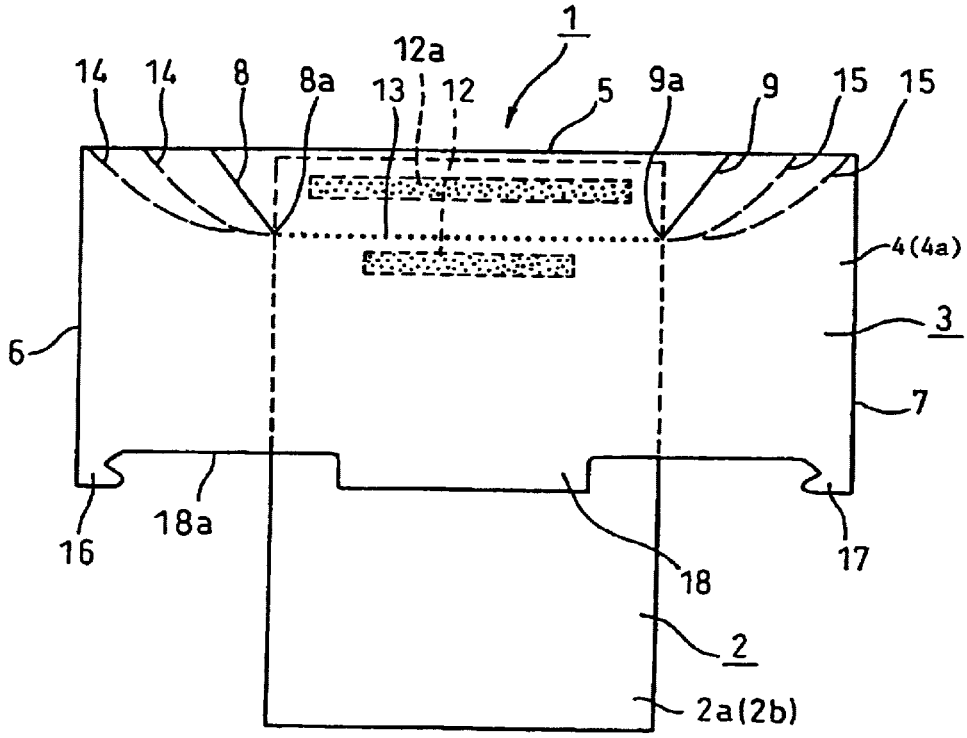
FIG. 3 shows an explanatory front view of another embodiment of the support-equipped, drink-extracting bag of the present invention.

Also, as shown in FIG. 3, a pair of middle aprons 18 may be formed in the lower middle portions of the front and back face sections of the support member and between the right and left lower end projections 16 and 17. When the support-equipped extracting bag having the lower end projections 16 and 17 and the middle aprons 18 as mentioned above is opened and placed on a cup in accordance with the procedures as mentioned above, the middle aprons 18 are positioned in the cup and the lower end projections 16 and 17 are positioned outside of the cup, and the lower ends of the aprons 18 and the projections 16 and 17 are located below the level of the upper edge of the cup. Therefore, even when the extracting bag member moves in any horizontal direction, the movement of the support member in any horizontal directions is restricted by any of the lower end projections 16 and 17 and the middle aprons 18, and thus the support member does not run outside of the cup. Therefore, an accident during the extracting procedure can be prevented.

Next, when hot water is poured into the bag member through the opening top end thereof, to apply a drip-extraction to the drink material contained in the bag member, an extract liquid having a flavour and a desired dark color falls into the cup through the bag member and is collected in the cup. With an increase in the amount of the collected extract liquid in the cup, the lower portion of the bag member is immersed in the collected extract liquid in the cup, and the residual drink material in the bag member is further immerse-extracted by the collected extract liquid, to supplement the concentration of the extract.

Namely, when the support-equipped extracting bag of the present invention is used, the two steps of extraction, namely the drip-extraction and the immerse-extraction can be successively carried out and thus the extraction effect can be enhanced.

In the support-equipped extracting bag of the present invention, the filtering sheet for forming the extracting bag member can be selected from conventional filtering sheets in consideration of the type, particle size and extraction properties of the drink materials to be extracted. Usually, the extracting bag member preferably comprises at least one nonwoven fabric comprising fine fibers having an individual fiber thickness of 0.22 dtex (0.2 denier). When the drink material is coffee, the extracting bag member preferably comprises a filtering sheet which does not allow coffee particles to pass therethrough, and can absorb an oily fraction contained in the extract liquid therewith to an appropriate extent, to remove the oily fraction, and thus to prevent the oily fraction rising to the surface of the coffee extract liquid.

The woven fabric usable as a filtering sheet is preferably selected from nonwoven fabrics made from fine polyolefin fibers, for example, fine polyethylene and polypropylene fibers. The fine fiber nonwoven fabric may be laminated on a support sheet consisting of another nonwoven fabric, for example, a filtering paper sheet. As a preferable embodiment of the filtering sheet usable for forming the extracting bag member of the present invention, a nonwoven fabric comprising melt-brown polypropylene fibers having a fiber thickness of 0.056 dtex (0.05 denier) and having a basis weight of 20 g/m$^2$ and a thickness of about 0.23 mm can be used. The nonwoven fabric may have fiber-fuse bonded portions formed by a heat-embossing treatment.

The support member usable for the present invention is preferably formed from a sheet material capable of safely holding the extracting bag member throughout the extraction procedure, and of allowing the tearing-open procedures of the support member to be easy, and the opened support member to be retained in the opened form. The sheet material for the support member is preferably a thick paper sheet; a plastic sheet or a foamed plastic sheet having a thickness of about 50 to 300 μm. Generally, a thick paper sheet coated with a water-proof layer is preferably used for the support member. The water-proof layer is not limited to a specific type of water-proof layer as long as the water-proof layer is stable under the extracting conditions, particularly the extracting temperature, and is not separated from the paper sheet when the support member is subjected to the opening procedure. Generally, the water-proof layer is formed by coating a paper sheet substrate with a polyethylene resin.

In the support-equipped extracting bag of the present invention, there is no specific limitation to the adhering method, the type of adhesive for adhering the support member to the extracting bag member in the adhesion regions. The adhesion may be effected by using a water-resistant adhesive, for example, ethylene-vinyl acetate copolymer resin, or by a thermal adhesion using a thermally fusible material, or utilizing the water-resistant resin coating layer formed on the support member. Other embodiments of the support-equipped extracting bag of the present invention will be explained below.

Figure 4:
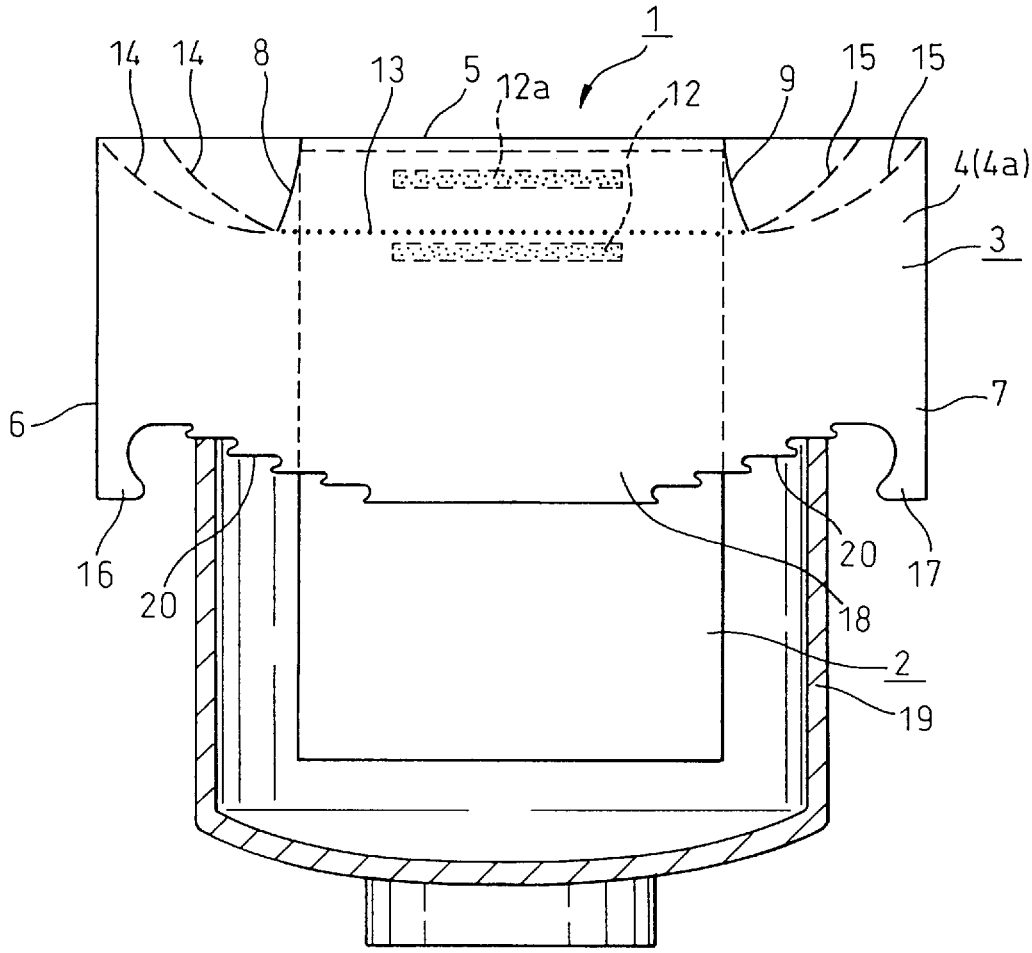
FIG. 4 shows an explanatory front view of still another embodiment of the support-equipped extracting bag of the present invention placed on a cup which is shown in a cross-sectional front view.

Referring to FIG. 4, a support-equipped extracting bag 1 of the present invention has a support member 3 adhered to an extracting bag member 2 at the adhesion regions 12 and 12*a*. In the support member 3, the cut lines 8 and 9 formed in the upper portion of the support member extend in outwardly inclined directions each from a points located on the ridgeline 5 and immediately outside of the right or left side upper edge of the extracting member 2 toward the right or left side lower end of the support member 3.

The cut lines 8 and 9 may formed at right angles to the ridgeline 5.

Also, in FIG. 4, the lower ends of the front and back face sections 4 and 4*a* of the support member 3 have middle aprons 18 and right and left side portions 20 each in a zigzag form, for example, in the form of a plurality of steps. When the support-equipped extracting bag 1 is opened and placed on a cup 19, any of the steps can come into contact with the upper edge of the cup 19 and restrict the horizontal movement of the support member 3 on the cup edge. Therefore, the opened support-equipped extracting bag of the present invention can be retained safely on the cup.

There is no specific limitation on the shape and the dimensions of the zigzag formed right and left side portions. As shown in FIG. 4, when the steps 20 each have a projection extending outward, the connection of the inside surface of the upper edge of the cup with the projections is ensured. Preferably, each step 20 has a height of 2 mm or more, more preferably 2 to 5 mm.

Figure 5:
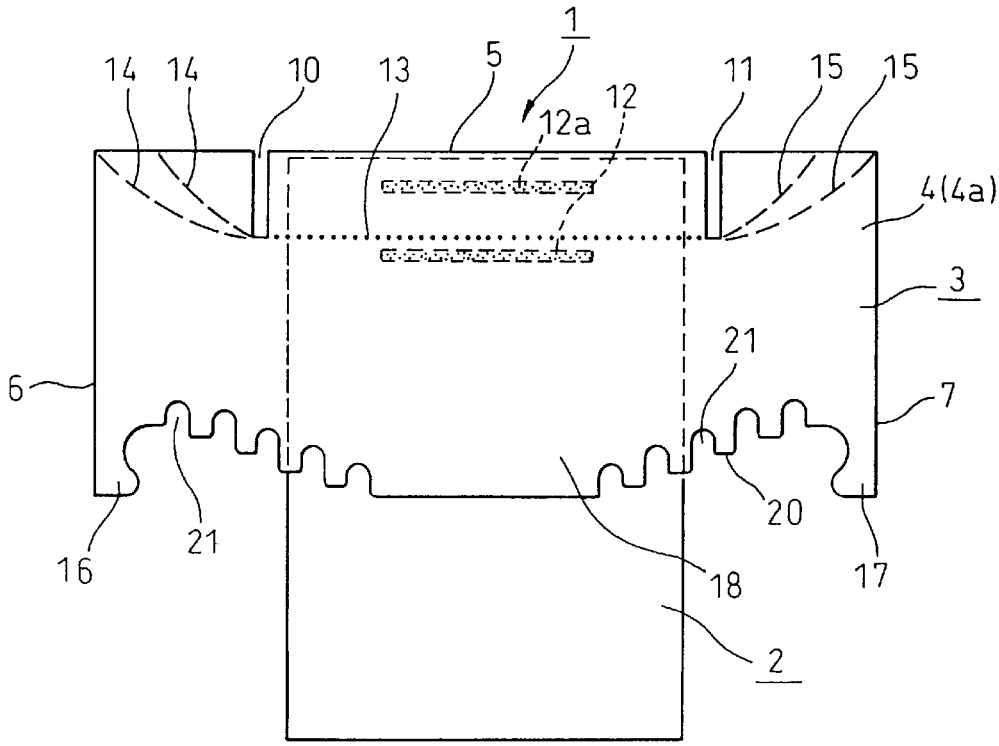
FIG. 5 shows an explanatory front view of still another embodiment of the support-equipped extracting bag of the present invention.

In the support-equipped extracting bag of the present invention as shown in FIG. 5, a pair of vacant areas 10 and 11 extending inward from the ridgeline 5, are formed, in place of the lines 8 and 9, in the upper portion of the support member 3.

The vacant areas shown in FIG. 4 are formed in the direction at right angles to the ridgeline 5. In another embodiment, the vacant areas 10 and 11 may be inclined inward or outward.

In FIG. 5, each of the front and back face sections 4 and 4*a* of the support member 3 has a middle apron 18 and right and left side portions 20 formed in the lower end thereof. The right and left side portions 20 have a plurality of projections 20 and a plurality of dents 21. The dents 21 contribute to enhancing the reliability of connection of the inner surface of the upper edge of the cup with the support member. The larger the depth of the dents 21, the higher the connection reliability.

Figure 6:
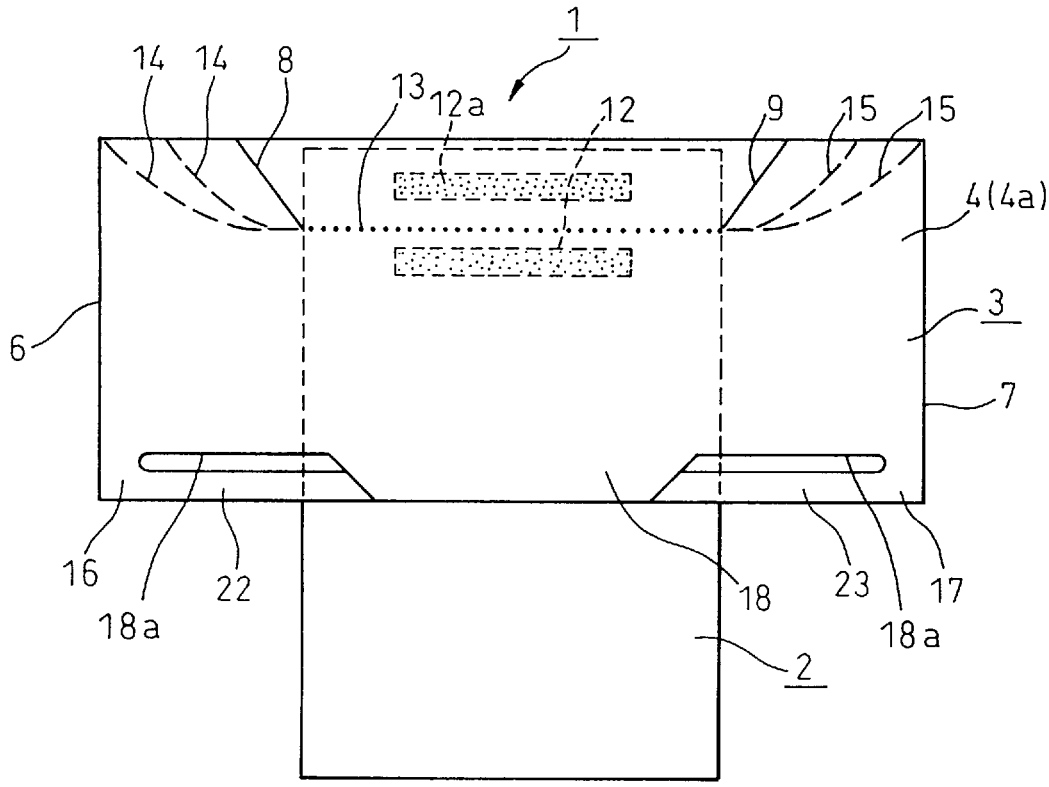
FIG. 6 shows an explanatory front view of still another embodiment of the support-equipped extracting bag of the present invention.

In the support-equipped extracting bag of the present invention as shown in FIG. 6, two pairs of transverse arms 22 and 23 extend from the lower end projections 16 and 17 of the right and left side edges, at which side edges the front and back face sections 4 and 4*a* of the support member 3 are connected to each other, toward the center portion of the lower ends of the support member 2, for example, the center of the middle apron 18.

Figure 7:
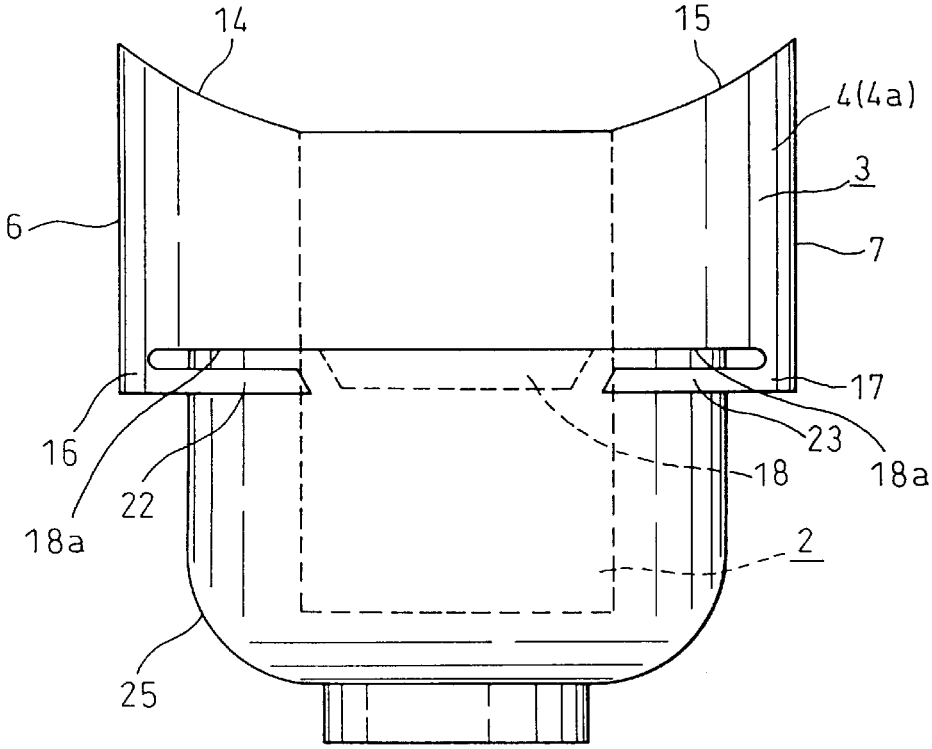
FIG. 7 shows an explanatory front view of the support-equipped extracting bag shown in FIG. 6, when opened and placed on a cup.
Figure 8:
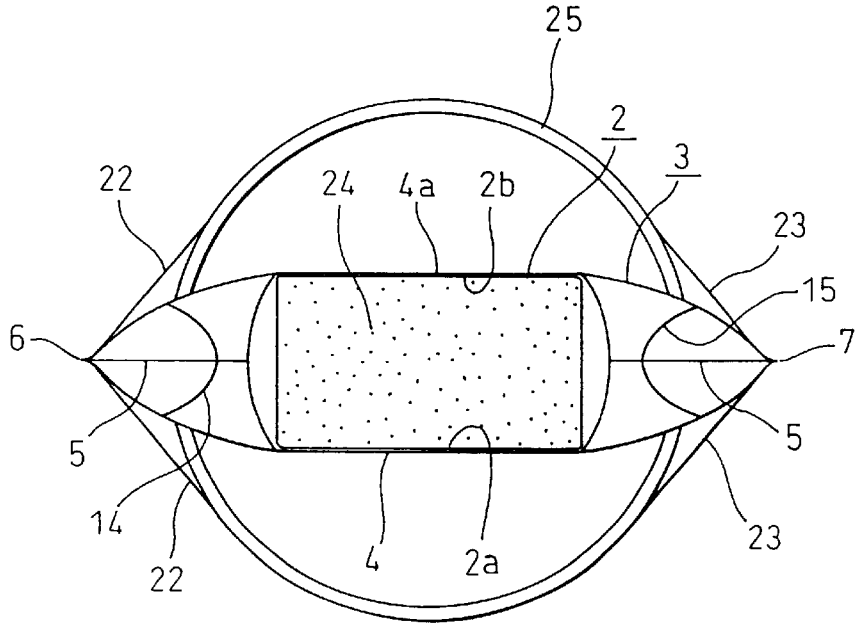
FIG. 8 shows an explanatory plane view of the support-equipped extracting bag shown in FIG. 6, when opened and placed on a cup.

When the support-equipped extracting bag of FIG. 6 is opened by removing the upper middle portion of the support member 3 and the top portion of the extracting bag member 2 and pushing and bending inward the right and left side end upper portions of the support member 2 along the fold or dotted cuts 14 and 15, and the opened support-equipped extracting bag is placed on a cup 25, as shown in FIGS. 7 and 8, the transverse arms 22 and 23 come into contact with the outer surface of the upper edge portion of the cup 25 so as to hold the cup 25 at four portions namely, front right and left and back right and left portions, thereof. Therefore, the support-equipped extracting bag of the present invention can be held on the cup.

In the embodiment shown in FIGS. 6, 7 and 8, vacant areas are formed above the transverse arms 22 and 23. The vacant areas may be replaced by cut lines. In this case, the formation of the vacant areas can be omitted.

Figure 9:
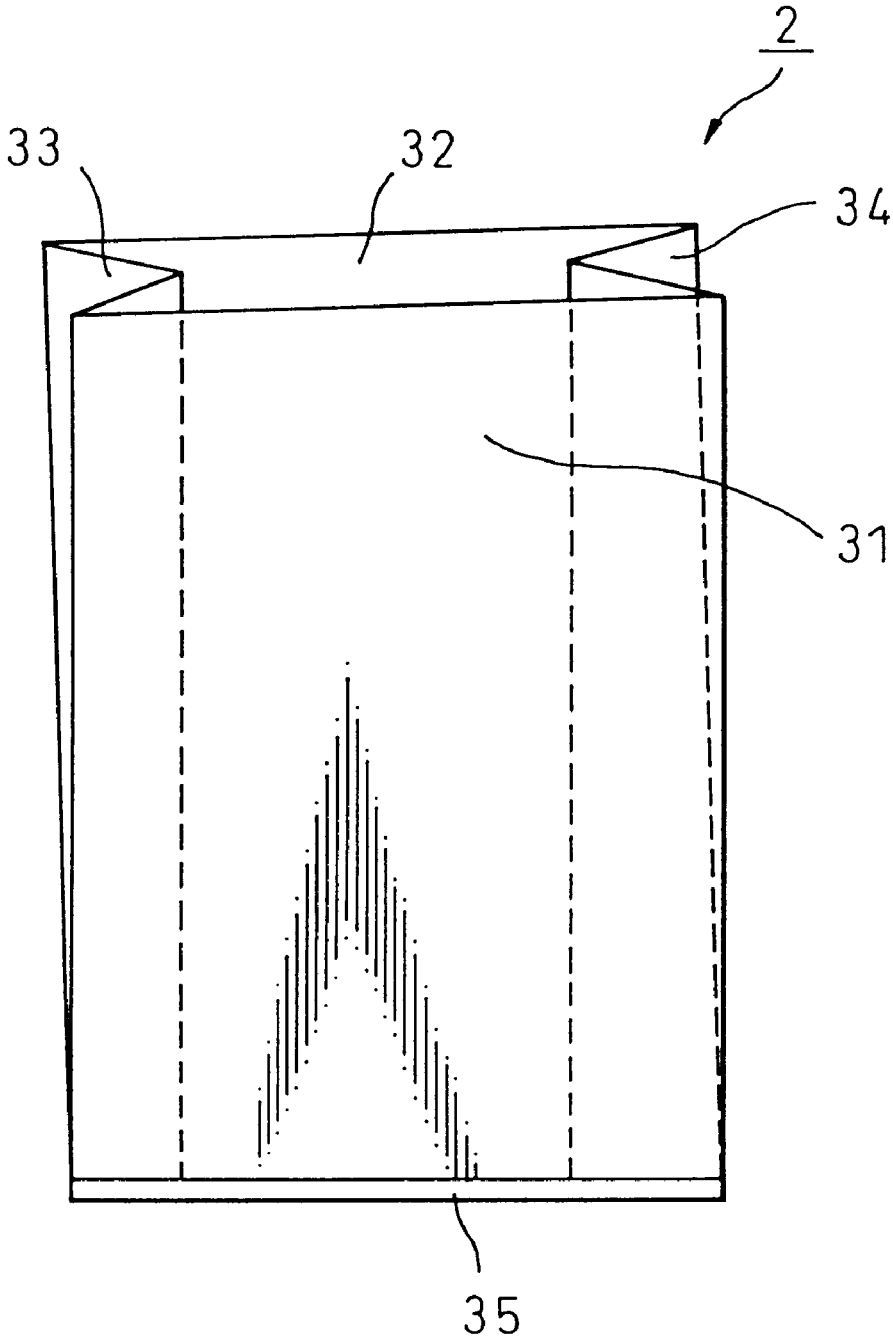
FIG. 9 shows an explanatory perspective view of an embodiment of the bag member usable for the present invention.

In the extracting bag member of the present invention, as shown in FIG. 9, a pair of side face sections 33 and 34 are formed between a front face section 31 and a back face section 32 which are connected at the side edges thereof to each other through the side face sections. These front, back and side face sections are connected together at the lower ends thereof to form a straight line-formed connection 35.

The provision of the side face sections 33 and 34 causes the capacity of the extracting bag member to increase and the opening of the top end of the bag member to be easy. Further, where the lower ends of the front, back and side face sections are connected together to form a straight line-formed bottom, and when the bag member is taken up from an extract liquid, removal of the liquid from the bag member bottom is easy. Each of the right and left side face sections may be bent inward as shown in FIG. 9, to form gussets.

INDUSTRIAL APPLICABILITY OF THE INVENTION

In the support-equipped extracting bag of the present invention, the upper middle portion of the support member and the top portion of the extracting bag member can be surely opened in a certain form and the opened form can be stably retained. Therefore, an extraction procedure can be applied to a drink material contained in the bag member in a constant manner.

When the upper portions of the bag and support members are removed by tear, since the top portion of the extracting bag member is covered by the support member, the tearing operation can be hygienically carried out without bringing fingers of the user into contact with the top portion of the extracting bag member. Further, since the support-equipped extracting bag of the present invention can be stably placed and held on a cup, the extraction procedure can be very safely carried out.

Also, when the extracting procedure is carried out using the support-equipped extracting bag of the present invention, a drip extraction and an immersion extraction can be successively carried out to thereby enhance the quality in taste, flavour, and color of the extract liquid, namely a drink.

What is claimed is:

1. A drink-extracting bag equipped with a support member for holding it on a cup, comprising both:

a closed extracting bag member 2 comprising right and left side edges, a closed bottom edge and a top edge, said bag member containing therein a drink material to be extracted and having a front face section 2*a* and back face section 2*b* each comprising a filtering sheet; and a closed support member 3 attached to the bag member, wherein;

said closed support member has a front face section 4 and a back face section 4*a*, each face section having a right and left side edge, a common top edge and a lower end which sections join each other through the common top edge forming a ridgeline 5, and said sections are connected to each other at the right and left side edges 6 and 7 of each face section said support member being wider than the closed bag member and sufficiently wide to be positioned onto the rim of said cup when said support member is in an open position;

an upper half portion of the extracting bag member being completely covered by the front and back face sections of the support member such that the top edge of the bag does not extend above the top edge of the support member and a lower half portion of the extracting bag member extends downward below the lower ends 18*a* of the front and back face sections of the support member;

a pair of cut lines 8 and 9 or vacant areas 10 or 11 formed in an upper portion of each of the front and back face sections of the support member, each cut line or vacant area extending from the ridgeline at a point spaced from said right and left side edges of said support member, respectively, downwardly toward the inside of the support member and located outside of the right and left side edges of the bag member;

the inner surfaces of the front and back face sections of the support members are respectively adhered to the corresponding upper portions of outer surfaces of the front and back face sections of the bag member in adhesion regions 12 located below and close to a pair of straight lines 8*a*–9*a* drawn between lowermost ends 8*a* and 9*a* of the pair of cut lines or vacant areas of the front and back face sections of the support member;

a row of perforations 13 for cutting or tearing are formed through an upper middle portion of the front and back face sections of the support member and through the top portion of the front and back face sections of the bag member, along the straight line 8*a*–9*a;* at least one pair of folds or dotted cuts 14 and 15 are formed in the right and left side upper portions of each of the front and back face sections of the support member between said side edges of said face sections and said cut lines or vacant areas of said face sections, to enable the right and left side upper portions of said face sections to be bent inward along the folds or dotted cuts; and the support member and the top portion of the bag member can be opened by removing the upper middle portion of the support member and the top portion of the bag member along the cut lines or vacant areas and the row of perforations, and by bending the right and left side upper portions of the support member inward.

2. The support member-equipped extracting bag as claimed in claim 1, wherein a pair of lower projections 16 and 17 extend downward from lower ends 18*a* of the right and left side edges of the front and back face sections of the support member through which side edges, the front and back face sections of the support member are connected to each other.

3. The support member-equipped extracting bag as claimed in claim 2, wherein two pairs of transverse arms 22 and 23 extend from the lower end projections 16 and 17 of the support member toward a center of the lower end of the support member.

4. A method of extracting a drink by employing the drink-extracting bag equipped with a support member for holding it on a cup, as claimed in claim 3, comprising:

removing the upper middle portion of the support member together with the top portion of the bag member, along the row of perforations formed in the support member and the bag member;

bending the right and left side upper portions of the support member inward, to open the support member and the top portion of the bag member;

placing the opened support member-equipped extracting bag on a cup in such a manner that the lower end of the support member comes into contact with an upper edge of the cup and the bag member is positioned in the cup;

extracting the drink by pouring hot water into the bag member through the opened top end thereof thereby causing a drip extraction of the drink material in the bag member and the extracted drink to fall into the cup through the bag member and to be collected in the cup, and allowing the lower half portion of the bag member to be immersed in the collected drink in the cup and the residual drink material in the lower half portion of the bag member to be immerse-extracted by the collected drink in the cup.

5. A method of extracting a drink by employing the drink-extracting bag equipped with a support member for holding it on a cup, as claimed in claim 2, comprising:

removing the upper middle portion of the support member together with the top portion of the bag member, along the row of perforations formed in the support member and the bag member;

bending the right and left side upper portions of the support member inward, to open the support member and the top portion of the bag member;

placing the opened support member-equipped extracting bag on a cup in such a manner that the lower end of the support member comes into contact with an upper edge of the cup and the bag member is positioned in the cup;

extracting the drink by pouring hot water into the bag member through the opened top end thereto thereby causing a drip extraction of the drink material in the bag member and the extracted drink to fall into the cup through the bag member and to be collected in the cup, and for allowing the residual drink material in the bag member to be immerse extracted by the collected drink in the cup.

6. The support member-equipped extracting bag as claimed in claim 1, wherein a pair of middle aprons 18 extend downward from middle portions of the lower ends 18*a* of the front and back face sections of the support member.

7. The support member-equipped extracting bag as claimed in claim 6, wherein right and left side portions 20 of each of the middle aprons 18 of the front and back face sections of the support member are in a zigzag form.

8. A method of extracting a drink by employing the drink-extracting bag equipped with a support member for holding it on a cup, as claimed in claim 7, comprising:

removing the upper middle portion of the support member together with the top portion of the bag member, along the row of perforations formed in the support member and the bag member;

bending the right and left side upper portions of the support member inward, to open the support member and the top portion of the bag member;

placing the opened support member-equipped extracting bag on a cup in such a manner that the lower end of the support member comes into contact with an upper edge of the cup and the bag member is positioned in the cup;

extracting the drink by pouring hot water into the bag member through the opened top end thereof thereby causing a drip extraction of the drink material in the bag member and the extracted drink to fall into the cup through the bag member and to be collected in the cup, and allowing the lower half portion of the bag member to be immersed in the collected drink in the cup, and the residual drink material in the lower half portion of the bag member to be immerse-extracted by the collected drink in the cup.

9. A method of extracting a drink by employing the drink-extracting bag equipped with a support member for holding it on a cup, as claimed in claim 6, comprising:

removing the upper middle portion of the support member together with the top portion of the bag member, along the row of perforations formed in the support member and the bag member;

bending the right and left side upper portions of the support member inward, to open the the support member and the top portion of the bag member;

placing the opened support member-equipped extracting bag on a cup in such a manner that the lower end of the support member comes into contact with an upper edge of the cup and the bag member is positioned in the cup;

extracting the drink by pouring hot water into the bag member through the opened top end thereof thereby causing a drip extraction of the drink material in the bag member and the extracted drink to fall into the cup through the bag member and to be collected in the cup, and allowing the lower half portion of the bag member to be immersed in the collected drink in the cup, and the residual drink material in the lower half portion of the bag member to be immerse-extracted by the collected drink in the cup.

10. The support member-equipped extracting bag as claimed in claim 1, wherein the bag member has a pair of right and left side face sections 33 and 34 formed between the front and back face sections, the lower ends of the front back and side face sections are connected altogether to form a straight line-formed bottom 35, each of the right and left side face portions 33 and 34 being folded inward to form a gusset.

11. A method of extracting a drink by employing the drink-extracting bag equipped with a support member for holding it on a cup, as claimed in claim 10, comprising:

removing the upper middle portion of the support member together with the top portion of the bag member, along the row of perforations formed in the support member and the bag member;

bending the right and left side upper portions of the support member inward, to open the support member and the top portion of the bag member;

placing the opened support member-equipped extracting bag on a cup in such a manner that the lower end of the support member comes into contact with an upper edge of the cup and the bag member is positioned in the cup;

extracting the drink by pouring hot water into the bag member through the opened top end thereof thereby causing a drip extraction of the drink material in the bag member and the extracted drink to fall into the cup through the bag member and to be collected in the cup, and allowing the lower half portion of the bag member to be immersed in the collected drink in the cup, and the residual drink material in the lower half portion of the bag member to be immerse-extracted by the collected drink in the cup.

12. A method of extracting a drink by employing the drink-extracting bag equipped with a support member for holding it on a cup, as claimed in claim 1, comprising:

removing the upper middle portion of the support member together with the top portion of the bag member, along the row of perforations formed in the support member and the bag member;

bending the right and left side upper portions of the support member inward, to open the support member and the top portion of the bag member;

placing the opened support member-equipped extracting bag on a cup in such a manner that the lower end of the support member comes into contact with an upper edge of the cup and the bag member is positioned in the cup;

extracting the drink by pouring hot water into the bag member through the opened top end thereof thereby causing a drip extraction of the drink material in the bag member and the extracted drink to fall into the cup through the bag member and to be collected in the cup, and allowing the lower half portion of the bag member to be immersed in the collected drink in the cup, and the residual drink material in the lower half portion of the bag member to be immerse-extracted by the collected drink in the cup.

* * * * *